US009562340B2

(12) United States Patent
Yoshida et al.

(10) Patent No.: US 9,562,340 B2
(45) Date of Patent: Feb. 7, 2017

(54) EXCAVATING BUCKET AND WORK VEHICLE

(71) Applicant: KOMATSU LTD., Tokyo (JP)

(72) Inventors: Tsuyoshi Yoshida, Tokyo (JP); Tatsuo Aira, Hirakata (JP); Daijiroh Tanaka, Hirakata (JP)

(73) Assignee: KOMATSU LTD., Tokyo (JP)

( * ) Notice: Subject to any disclaimer, the term of this patent is extended or adjusted under 35 U.S.C. 154(b) by 460 days.

(21) Appl. No.: 14/241,120

(22) PCT Filed: Sep. 26, 2013

(86) PCT No.: PCT/JP2013/076117

§ 371 (c)(1),
(2) Date: Feb. 26, 2014

(87) PCT Pub. No.: WO2014/171024

PCT Pub. Date: Oct. 23, 2014

(65) Prior Publication Data

US 2016/0251821 A1 Sep. 1, 2016

(30) Foreign Application Priority Data

Apr. 16, 2013 (JP) ..... 2013-085928

(51) Int. Cl.
*E02F 3/40* (2006.01)
*E02F 3/32* (2006.01)
*E02F 9/28* (2006.01)

(52) U.S. Cl.
CPC .. *E02F 3/40* (2013.01); *E02F 3/32* (2013.01); *E02F 9/2808* (2013.01)

(58) Field of Classification Search
CPC ..... E02F 3/40; E02F 9/2808; E02F 9/2825; E02F 9/2833

(Continued)

(56) References Cited

U.S. PATENT DOCUMENTS

2011/0289803 A1 12/2011 Folkerts et al.
2012/0301258 A1 11/2012 Nagata et al.

FOREIGN PATENT DOCUMENTS

DE 19 40 085 U 6/1966
JP 58-45760 U 3/1983

(Continued)

OTHER PUBLICATIONS

The International Search Report for the corresponding international application No. PCT/JP2013/076117, issued on Dec. 17, 2013.

(Continued)

*Primary Examiner* — Michael McCullough
*Assistant Examiner* — Brendan Tighe
(74) *Attorney, Agent, or Firm* — Global IP Counselors, LLP

(57) ABSTRACT

An excavating bucket includes a bottom surface section, a bucket body having a rear surface section and a side surface section, a lip section, a bracket, and teeth. The lip section is fixed to an edge portion of the bucket body at an opposite side to the rear surface section. The bracket has a hole through which a coupling pin for attaching to the arm passes. When the length of a virtual line S1 linking the center of the hole and the front end of the lip section is set as a wrist radius V, a length of the longest line segment perpendicular to the virtual line S1 from the virtual line S1 to the bottom surface section is set as a bucket depth D, and the angle formed between the lip section and the virtual line S1 is set as a lip angle θ, $62° \leq \theta \leq 72°$ and $0.7 \leq D/V \leq 0.8$.

4 Claims, 16 Drawing Sheets

(58) Field of Classification Search
USPC ..... 37/444, 454, 455, 456
See application file for complete search history.

(56) References Cited

FOREIGN PATENT DOCUMENTS

| | | | |
|---|---|---|---|
| JP | 60-223534 | A | 11/1985 |
| JP | 4-117046 | U | 10/1992 |
| WO | 2011/049061 | A1 | 4/2011 |

OTHER PUBLICATIONS

The Office Action for the corresponding German patent application No. 11 2013 000 157.8, issued on Mar. 11, 2015.

EXCAVATING BUCKET AND WORK VEHICLE

CROSS-REFERENCE TO RELATED APPLICATIONS

This application is a U.S. National stage application of International Application No. PCT/JP2013/076117, filed on Sep. 26, 2013. This U.S. National stage application claims priority under 35 U.S.C. §119(a) to Japanese Patent Application No. 2013-085928, filed in Japan on Apr. 16, 2013, the entire contents of which are hereby incorporated herein by reference.

BACKGROUND

Field of the Invention

The present invention relates to an excavating bucket and a work vehicle.

Description of the Related Art

An excavating bucket which is mounted in a work vehicle is provided with a plurality of teeth, a bracket, and a bucket body. The teeth are provided at a front side upper section of the bucket body. The bracket is provided on a rear surface section of the bucket body. In addition, a hole is provided in the bracket and the excavating bucket is attached to an arm by passing a coupling pin through the hole. Due to this, the excavating bucket is attached to the arm so as to be able to rotate centering on the coupling pin.

As such an excavating bucket, a configuration is disclosed (for example, refer to Japanese Unexamined Patent Application Publication No. H4-117046) where there is a bottom surface section where a linear section, an arc section and a linear section are formed in this order from the teeth side in a side view.

Furthermore, an excavating bucket is proposed (for example, refer to International Publication No. 2011/049061) which lengthens the life of the excavating bucket by reducing excavation resistance and reducing wear. In the excavating bucket, a bottom surface section is formed which has two curved surface sections with different radii of curvature in a side view.

SUMMARY

However, in the excavating bucket in the conventional art described above, there are the following problems.

That is, in a case where it is desirable to increase the capacity of the excavating bucket, twisting or the like is easily generated during operation and the load on the arm is increased when the capacity of the excavating bucket is increased by widening the width of the excavating bucket.

An object of the present invention is to provide an excavating bucket and a work vehicle which are able to achieve an increase in capacity while suppressing the load on an arm in consideration of the problems of the conventional excavating buckets.

An excavating bucket according to a first aspect is an excavating bucket which is attached to an arm of a work vehicle and is provided with a bucket body, a lip section, a bracket, and a cutting edge section. The bucket body has a bottom surface section which has two curved surface sections with different radii of curvature in a side view, a rear surface section which is linked with the bottom surface section, and a pair of side surface sections which cover sides of a space which is surrounded by the bottom surface section and the rear surface section. The lip section is fixed to an edge portion of the bucket body at an opposite side to the rear surface section. The bracket has a hole, through which a coupling pin for attaching to the arm passes, and is fixed to the rear surface section. The cutting edge section is fixed to the lip section. The length of a virtual line which connects the center of the hole in the bracket and a front end of the lip section in a side view is set as a wrist radius. The line segment which is the longest among the line segments which are perpendicular with regard to the virtual line and are from the virtual line to the bottom surface section in a side view is set as a second virtual line and the length of the second virtual line is set as the depth of the bucket. The size of an angle which is formed by the lip section and the virtual line in a side view is set as a lip angle. The following is satisfied in a case where the wrist radius is set as V, the depth of the bucket is set as D, and the lip angle is set as θ: $62° \leq \theta \leq 72°$ and $0.7 \leq D/V \leq 0.8$.

Since the curvature of the bottom surface section is increased and it is possible to deepen the depth of the bucket by setting the lip angle θ to 62° or more, it is possible to achieve an increase in the capacity (the bucket capacity) even with the same width as the excavating buckets in the conventional art. In this manner, since it is possible to increase the capacity without changing the width of the excavating bucket, it is possible to achieve an increase in capacity while suppressing the load on the arm.

In addition, the excavating bucket rotates centering on the hole in the bracket during excavation, but it is possible for the bottom surface section to not protrude below the trajectory of the leading edge of the cutting edge portion by setting the lip angle θ to 72° or less. As a result, it is possible to reduce the excavation resistance. In addition, since the curvature of the bottom surface section increases when the lip angle θ is larger than 72°, there are cases where it is difficult to secure the discharging performance of the soil which is excavated. As a result, it is possible to secure the soil discharging performance by setting the lip angle θ to 72° or less.

In addition, since an increase in the bucket capacity compared to the conventional art is achieved by adjusting the lip angle θ, it is possible to set the wrist radius to the same length in the excavating bucket of the first aspect as the excavating buckets in the conventional art. Since control values of the body side of a hydraulic excavator are set according to the wrist radius, it is possible to easily switch the excavating bucket of the first aspect without changing the control values.

Furthermore, the depth of the bucket is deepened by setting the depth of the bucket divided by the wrist radius to 0.7 or more and it is possible to achieve an increase in the capacity compared to the conventional art. In addition, when the depth of the bucket divided by the wrist radius is larger than 0.8, there are cases where the depth of the bucket is excessively deep with regard to the wrist radius and it is difficult to secure the soil discharging performance or cases where the excavation resistance increases. As a result, it is possible to secure the soil discharging performance while reducing excavation resistance by setting the depth of the bucket divided by the wrist radius to 0.8 or less.

The excavating bucket according to the second aspect is the excavating bucket according to the first aspect, where the following is satisfied in a case where the width of the excavating bucket (the bucket width) is set as Z: $0.73 \leq D/Z \leq 0.83$.

When the value of the depth of the bucket divided by the bucket width increases, it is possible to increase the capacity of the bucket with regard to the bucket width. That is, by setting the value of the depth of the bucket divided by the bucket width to 0.73 or more, it is possible to increase the bucket capacity compared to the conventional art even when the width is the same as the excavating buckets in the conventional art. In addition, when the value of the depth of the bucket divided by the bucket width is larger than 0.83, there are cases where the depth of the bucket is excessively deep with regard to the bucket width and it is difficult to secure the soil discharging performance or cases where the excavation resistance increases. As a result, by setting the value of the depth of the bucket divided by the bucket width to 0.83 or less, it is possible to secure the soil discharging performance while reducing excavation resistance.

A work vehicle according to the third aspect is provided with a vehicle body, a boom which is attached to the vehicle body, an arm which is attached to the boom, and the excavating bucket according to the first aspect or the second aspect which is attached to the arm.

Due to this, since it is possible to increase the capacity without changing the width of the excavating bucket, it is possible to achieve an increase in capacity while suppressing the load on the arm.

According to the present invention, it is possible to provide an excavating bucket where it is possible to achieve an increase in capacity while suppressing the load on an arm, and a work vehicle.

DETAILED DESCRIPTION OF THE INVENTION

A work vehicle and an excavating bucket according to the first embodiment of the present invention are as follows when described with reference to FIG. 1 to FIG. 16.

Overall Configuration of Hydraulic Excavator 100

Figure 1:
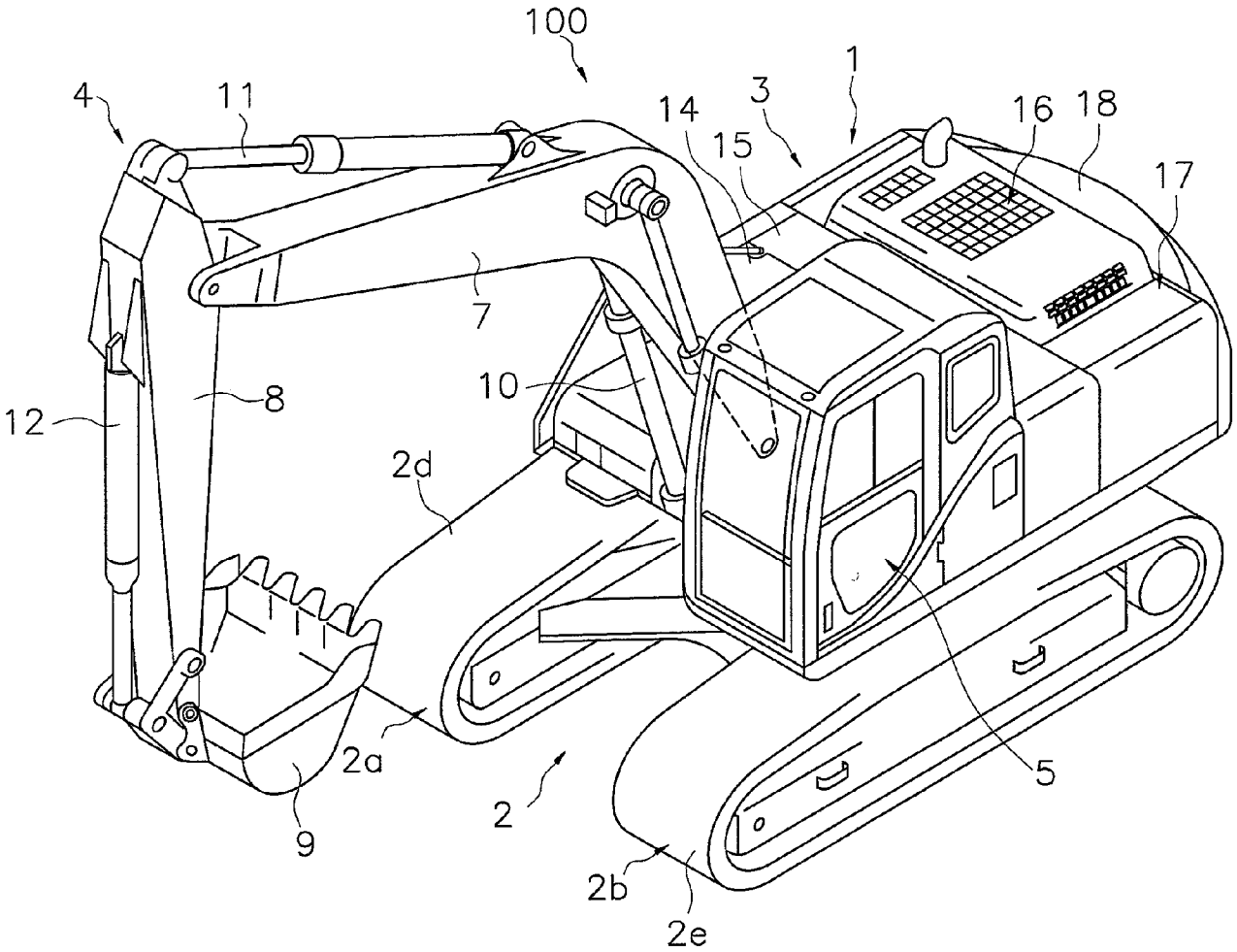
FIG. 1 is an external perspective view of a hydraulic excavator according to an embodiment of the present invention.

FIG. 1 is a view illustrating a hydraulic excavator 100 according to an embodiment of the present invention. The hydraulic excavator 100 is provided with a vehicle body 1 and a work implement 4.

The vehicle body 1 has a traveling body 2 and a revolving body 3. The traveling body 2 has a pair of travel apparatuses 2*a* and 2*b*. Each of the travel apparatuses 2*a* and 2*b* has crawler belts 2*d* and 2*e* and the hydraulic excavator 100 travels by the crawler belts 2*d* and 2*e* being driven with using driving force from an engine.

The revolving body 3 is mounted onto the traveling body 2. The revolving body 3 is provided so as to be able to revolve with regard to the traveling body 2. In addition, a cab 5 is provided at a front section left side position of the revolving body 3. Here, in the description of the entire configuration, the front and back direction has the meaning of the front and back direction of the cab 5. Furthermore, the front and back direction of the vehicle body 1 matches the front and back direction of the cab 5, that is, the revolving body 3. In addition, the left and right direction or the lateral direction has the meaning of the vehicle width direction of the vehicle body 1.

The revolving body 3 has a fuel tank 14, a hydraulic oil tank 15, an engine compartment 16, and a storage chamber 17. The fuel tank 14 stores fuel for running the engine which will be described later. The fuel tank 14 is arranged in front of the hydraulic oil tank 15. The hydraulic oil tank 15 stores hydraulic oil which is discharged from a hydraulic pump which is not shown in the view and supplied to hydraulic cylinders 10 to 12. The engine compartment 16 stores the engine in an inner section. The storage chamber 17 is arranged to the rear of the cab 5 and is arranged to line up with the engine compartment 16 in the vehicle width direction. A storage space, which stores a radiator and a radiator fan for cooling the engine which are not shown in the view, is provided in the inner section of the storage chamber 17. A counterweight 18 is provided to the rear of the engine compartment 16 and the storage chamber 17.

The work implement 4 is attached to the front section center position of the revolving body 3 and has a boom 7, an arm 8, and an excavating bucket 9. A base end portion of the boom 7 is joined to the revolving body 3 so as to be able to be derricked. In addition, a front end portion of the boom 7 is joined to a base end portion of the arm 8 so as to be able to be derricked. A front end portion of the arm 8 is joined to the excavating bucket 9 so as to be able to be derricked. In addition, the hydraulic cylinders 10 to 12 (a boom cylinder 10, an arm cylinder 11, and a bucket cylinder 12) are arranged so as to respectively correspond to the boom 7, the arm 8, and the excavating bucket 9. The work implement 4 is driven by actuating the hydraulic cylinders 10 to 12. Due to this, work such as excavation is performed.

Configuration of Excavating Bucket 9

Figure 2:
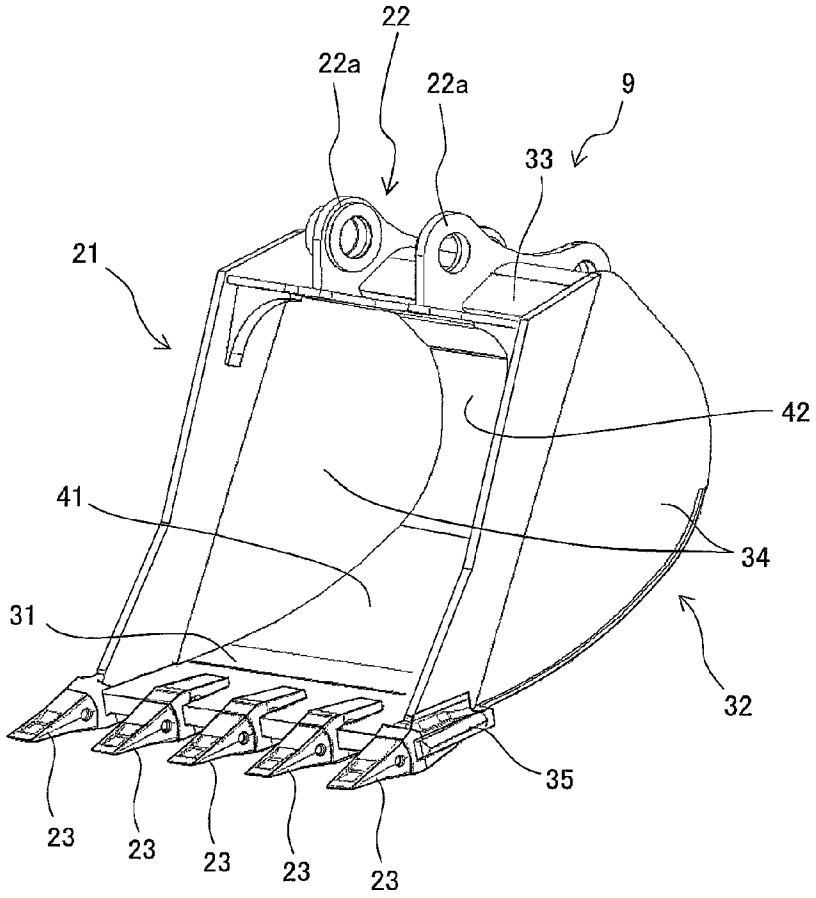
FIG. 2 is a perspective view of an excavating bucket of FIG. 1.

FIG. 2 is a perspective view of the excavating bucket 9 according to an embodiment of the present invention. FIG.

Figure 3:
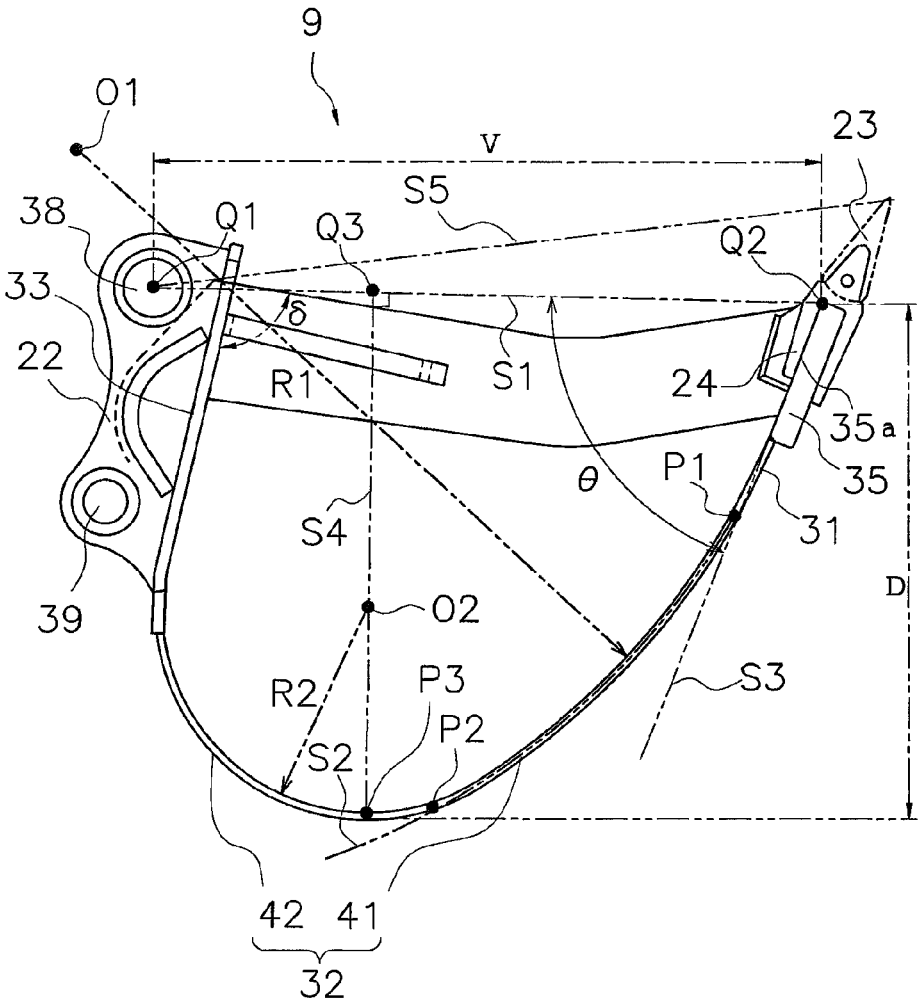
FIG. 3 is a side view of the excavating bucket of FIG. 2 in a horizontal state.
Figure 4:
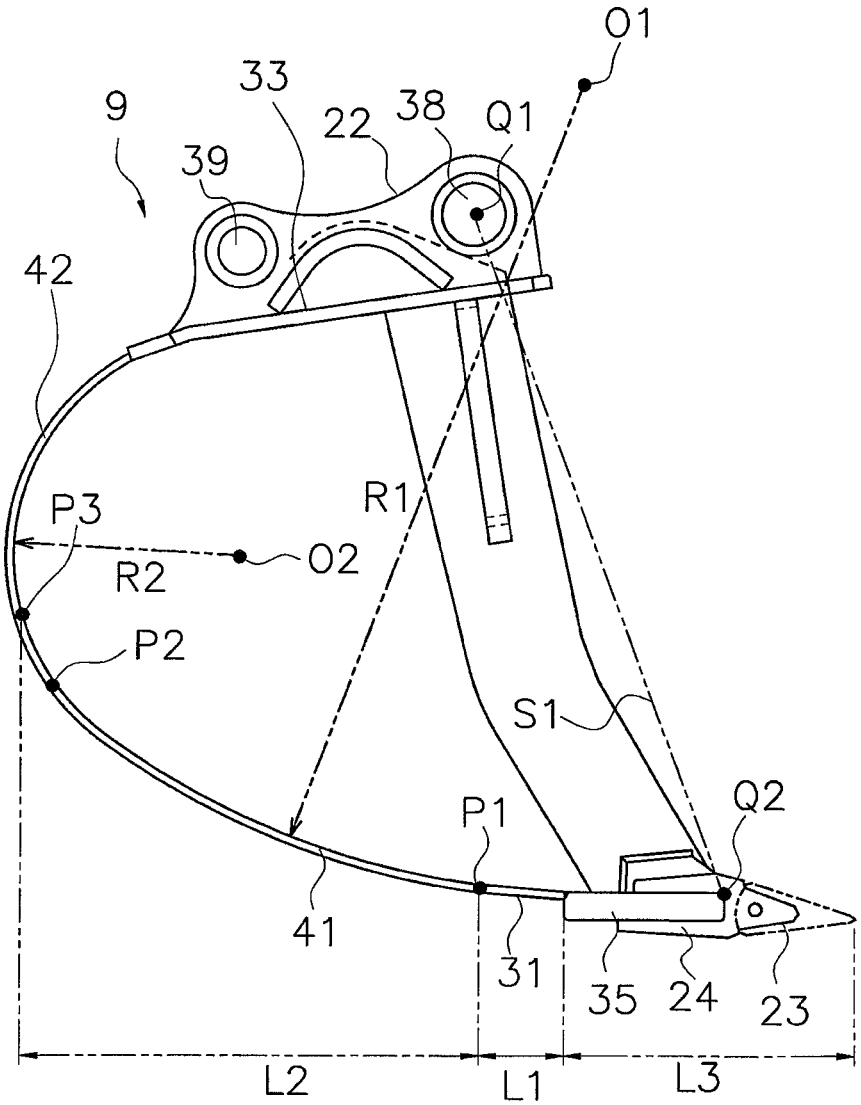
FIG. 4 is a side view of the excavating bucket of FIG. 2 in a state where the lip section is arranged horizontally.
Figure 5:
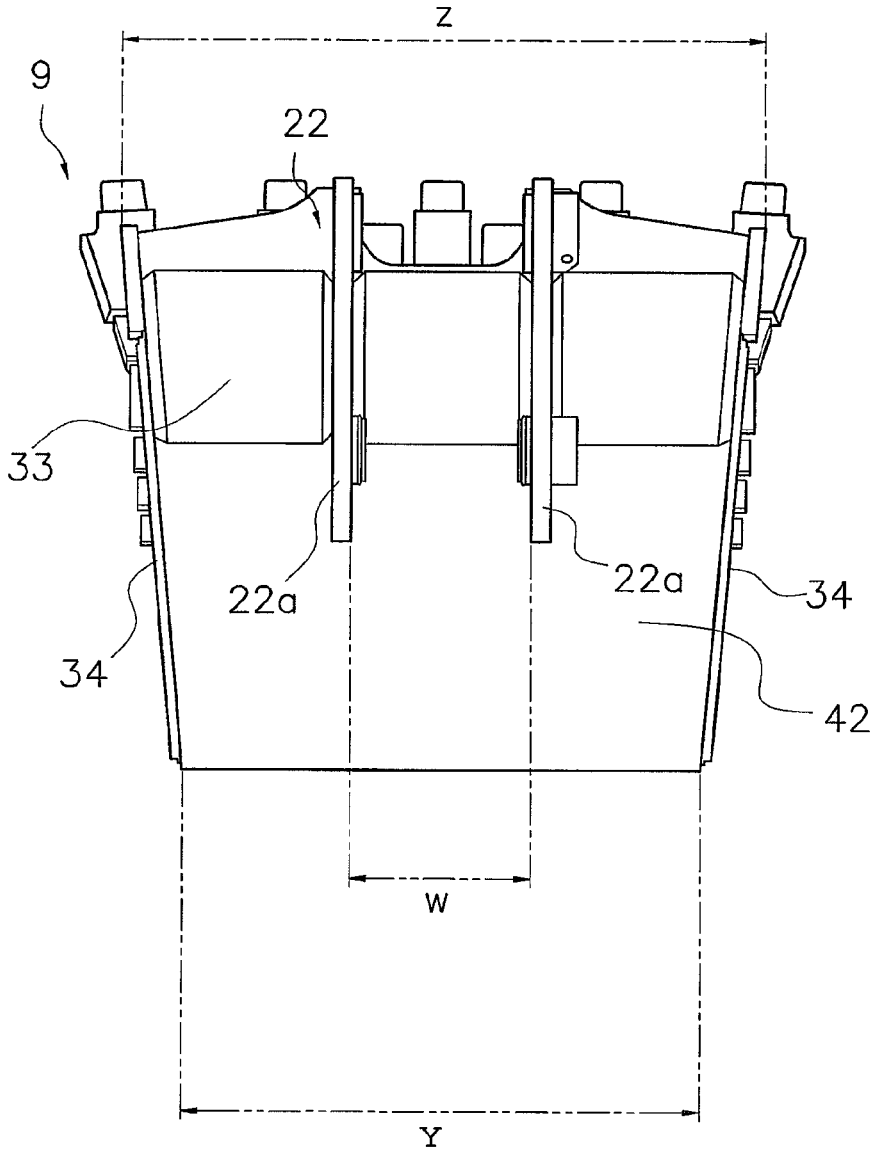
FIG. 5 is a rear view of the excavating bucket of FIG. 2.

3 is a side view of the excavating bucket 9 of FIG. 2. FIG. 4 is a side view of the excavating bucket 9 of FIG. 2 and is a view where the inclination of the excavating bucket 9 is different to FIG. 3. FIG. 5 is a rear view of the excavating bucket 9 of FIG. 2.

As shown in FIG. 2 to FIG. 5, the excavating bucket 9 is provided with a bucket body 21, a lip section 35, tooth adapters 24, a bracket 22, and a plurality of teeth 23 (one example of a cutting edge portion).

The bucket body 21 has a front surface section 31, a bottom surface section 32, a rear surface section 33, and a pair of side surface sections 34. The front surface section 31 is a member with a flat plate shape and has a linear shape in a side view. The bottom surface section 32 is a member with a curved plate shape and has a shape which is curved in a convex manner toward the outside of the bucket body 21 in a side view. The bottom surface section 32 is linked with the front surface section 31. The rear surface section 33 has a shape where a member with a plate shape is bent. The rear surface section 33 is linked with the bottom surface section 32. The pair of side surface sections 34 are arranged to be spaced from each other at a distance and cover the sides of a space which is surrounded by the front surface section 31, the bottom surface section 32, and the rear surface section 33.

The lip section 35 is a member with a flat plate shape and has a linear shape in a side view. The lip section 35 is a portion which the tooth adapters 24 are attached and which the teeth 23 are fixed on. The lip section 35 is fixed to an edge portion of the bucket body 21 at an opposite side to the rear surface section 33. In detail, the lip section 35 is fixed to the edge portion of the front surface section 31. The thickness of the lip section 35 is thicker than the thickness of the front surface section 31.

The bracket 22 is a member for attaching the excavating bucket 9 to the arm. The bracket 22 is fixed to the rear surface section 33. The bracket 22 has two attachment sections 22*a* which are erected from the rear surface section 33 toward the outside. Each of the attachment sections 22*a* is a member with a plate shape and is arranged with a perpendicular orientation with regard to the width direction of the excavating bucket 9. In addition, the two attachment sections 22*a* are provided to be opposed with an interval W as shown in FIG. 5. The interval is set as a bracket width W. A first hole 38 and a second hole 39 are formed in each of the attachment sections 22*a*. A coupling pin (which is not shown in the view) for attaching the bracket 22 to the arm passes through the first hole 38. The second hole 39 is formed on the bottom surface section 32 side of the first hole 38 and a coupling pin (which is not shown in the view) for attaching the bracket 22 to the bucket cylinder 12 (refer to FIG. 1) passes through the second hole 39.

The plurality of teeth 23 are fixed to the lip section 35 via the tooth adapters 24. The teeth 23 are arranged to be spaced from each other at an interval along the end portion of the lip section 35. The teeth 23 each have a tapered shape in a side view.

Configuration of Bucket Body 21

Next, the details of the shape of the bucket body 21 will be described. Here, in the description of the configuration of the excavating bucket 9, the front end side of the teeth 23 is referred to as the "front" and the first hole 38 side is referred to as the "rear" in the state shown in FIG. 3.

The bottom surface section 32 described above has a first curved surface section 41 and a second curved surface section 42. The first curved surface section 41 is linked with the front surface section 31. Accordingly, the front surface section 31 is positioned between the first curved surface section 41 and the lip section 35.

The first curved surface section 41 has a shape which is curved with a predetermined first curvature radius R1 in a side view. A center O1 of the curvature radius of the first curved surface section 41 is positioned outside the bucket body 21. In addition, the center O1 is positioned above and to the rear of the center of the first hole 38 in the state shown in FIG. 3 in a side view. The second curved surface section 42 is positioned at the rear surface section 33 side from the first curved surface section 41, that is, to the rear, and is linked with the first curved surface section 41. The second curved surface section 42 has a shape which is curved with a predetermined second curvature radius R2 in a side view. The second curvature radius R2 is smaller than the first curvature radius R1. A center O2 of the curvature radius of the second curved surface section 42 is positioned inside the bucket body 21.

Here, the length of a virtual line S1 (an example of a virtual line) which connects a center Q1 of the first hole 38 in the bracket 22 and a front end Q2 of the lip section 35 in a side view is set as a wrist radius V. In more detail, the front end Q2 is a front end of an inner plane 35*a* of the lip section 35. In addition, a virtual plane which includes the inner plane 35*a* of the lip section 35 in a side view is set as a reference plane S3. The angle which is formed by the reference plane S3 and the wrist radius V in the side view is set as the lip angle θ.

In addition, a virtual curved surface with a shape which is curved with a curvature radius which is the length of an excavation diameter S5 (refer to FIG. 3) from the center of the hole 38 up to the front ends of the teeth 23 is set as a reference curved surface S2, which is in contact with the end portion of the first curved surface section 41 which is positioned at the lip section 35 side, that is, the first curved surface section 41 at a connecting section P1 of the front surface section 31 and the first curved surface section 41 in the side view. In addition, a state where the virtual line S1 is arranged horizontally and the bottom surface section 32 is positioned below the virtual line S1 as shown in FIG. 3 is referred to as a "horizontal state".

In the present embodiment, the first curved surface section 41 is arranged along the reference curved surface S2 in a side view. As shown in FIG. 3, a connecting section P2 of the first curved surface section 41 and the second curved surface section 42 is positioned at the front side, that is at the front surface section 31 side, of a portion P3 which is positioned to be the lowest with regard to the bottom surface section 32 in the horizontal state in a side view. Accordingly, the portion P3 which is positioned to be the lowest with regard to the bottom surface section 32 in the horizontal state is included in the second curved surface section 42. That is, the first curved surface section 41 of the excavating bucket 9 according to the present embodiment is larger compared to an excavating bucket 109 according to comparative example 1 which will be described later in FIG. 7, and the large of the second curved surface section 42 is secured without excessively reducing the second curved surface section 42. As a result, it is easy for earth to come into the bucket body 21.

In addition, the length of a virtual line S4 (an example of a second virtual line) which runs down perpendicularly from the virtual line S1 toward the portion P3 is set as a bucket depth D. In other words, it is possible to say that the virtual line S4 is the line segment which is the longest among the line segments which are perpendicular with regard to the virtual line S1 and are from the virtual line S1 up to the bottom surface section 32 in the side view.

As shown in FIG. 4, the length of the front surface section 31 in the side view is smaller than the length of the first curved surface section 41 in the direction along the lip section 35. In detail, a length L1 of the front surface section 31 in the direction along the lip section 35 is smaller than a length L2 of the first curved surface section 41 in the direction along the lip section 35. As a result, it is possible to shorten the lip section 35. The manufacturing costs increase along with the length of the lip section 35 since the lip section 35 is formed to be thicker than the front surface section 31 in order to increase its strength. Accordingly, by it being possible to shorten the lip section 35, it is possible to reduce the manufacturing costs. In addition, in a case where the bottom surface section 32 is formed by roll machining of a sheet material, it is possible to use the portion where roll machining is not carried out as it is as the front surface section 31. As a result, it is possible to improve the yield of the material.

In addition, the length L1 of the front surface section 31 in the direction along the lip section 35 is smaller than a length L3 of the lip section 35 and the teeth 23 in the direction along the lip section 35. The length of the front surface section 31 in the direction along the lip section 35 is smaller than the second curvature radius R2. In addition, the connecting section P1 of the front surface section 31 and the first curved surface section 41 is positioned at a position which is higher than the center O2 of the curvature radius of the second curved surface section 42 in the horizontal state as shown in FIG. 3.

As shown in FIG. 3, an angle δ which is formed by the virtual line S1 and the rear surface section 33 is an obtuse angle in the side view. The rear surface section 33 is inclined in the horizontal state, so as to be positioned to the rear heading to the lower side. The upper section of the rear surface section 33 is positioned to the front side of the first hole 38 and the lower section of the rear surface section 33 is positioned below the first hole 38. As a result, the space inside the bucket body 21 in the horizontal state is shaped to be wider to the rear heading to the lower side. As a result, a wide space is secured at the rear side inside the bucket body 21. As a result, it is possible to increase the capacity of the excavating bucket 9.

In addition, the width of the upper end of the excavating bucket 9 is set as a bucket width Z and the width of the bottom surface section of the excavating bucket 9 is set as a bucket bottom width Y as shown in FIG. 5.

In addition, the lip angle θ described above satisfies the following (formula 1).

$$62° \leq \theta \leq 72° \qquad \text{Formula 1}$$

The ratio D/V of the bucket depth D and the wrist radius V satisfies the following (formula 2).

$$0.7 \leq D/V \leq 0.8 \qquad \text{Formula 2}$$

When the capacity of the excavating bucket 9 described above is set to V ($m^3$), the relationship of V/W of the bucket capacity V ($m^3$) and the bracket width W (m) satisfies the following (formula 3).

$$6 \leq V/W \leq 11 \qquad \text{Formula 3}$$

The ratio D/Z of the bucket depth D described above and the bucket width Z described above satisfies the following (formula 4).

$$0.73 \leq D/Z \leq 0.83 \qquad \text{Formula 2}$$

The ratio R1/V of the wrist radius V and the first curvature radius R1 described above (referred to below as the "wrist radius ratio") satisfies the following (formula 5).

$$0.65 \leq R1/V \leq 1.2 \qquad \text{Formula 5}$$

For example, in a case where R1=1800 mm and V=1608 mm, R1/V=1.12.

Next, the characteristics of the excavating bucket 9 according to the present embodiment will be described compared to excavating buckets according to the comparative examples.

Excavation Resistance of Excavating Bucket

In the excavating bucket 9 according to the present embodiment, the first curved surface section 41 is arranged along the reference curved surface S2. The reference curved surface S2 is a curved surface which approximates the trajectory of the front ends of the teeth 23 during excavation. As a result, by arranging the first curved surface section 41 along the reference curved surface S2, it is possible to reduce contact pressure between the bottom surface section 32 and the ground surface.

Figure 6:
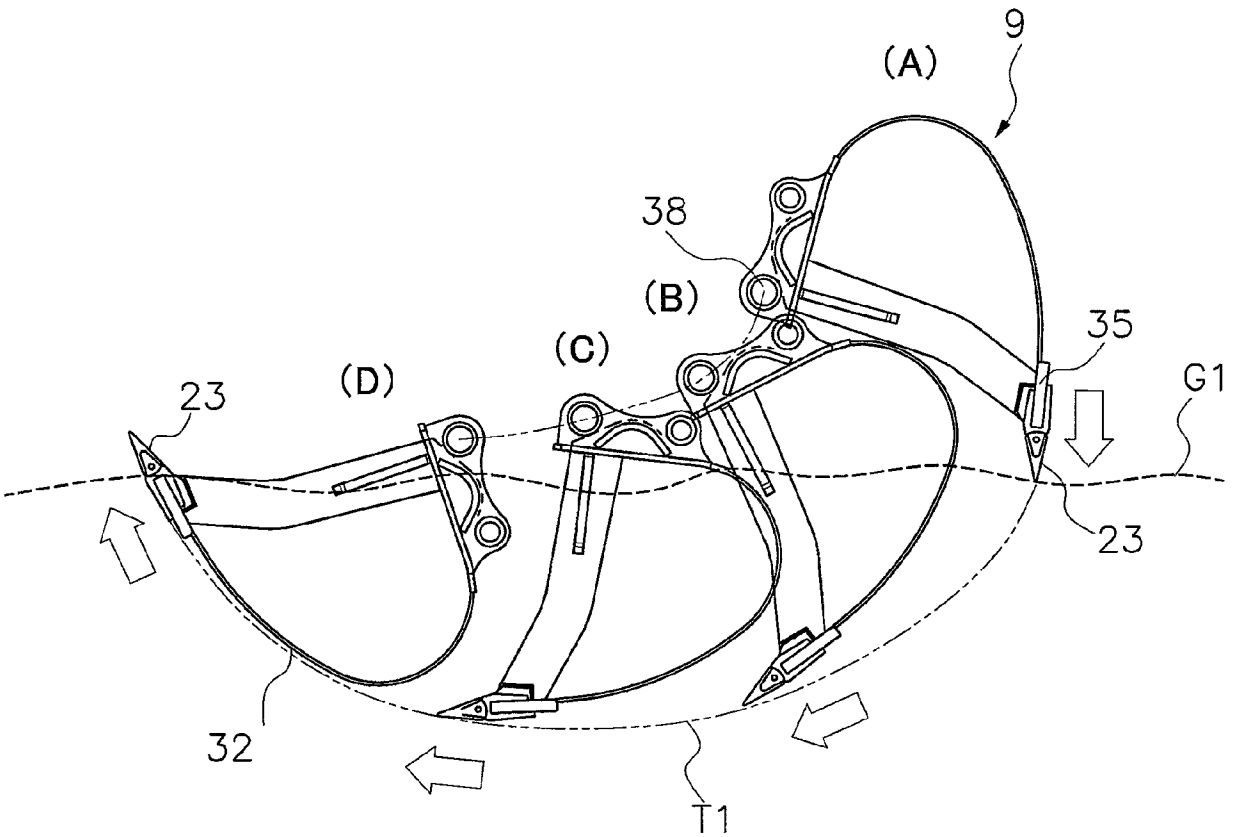
FIG. 6 is a view illustrating a trajectory of the excavating bucket of FIG. 2.

FIG. 6 illustrates the trajectory of the excavating bucket 9 when performing excavation by the excavating bucket 9 being moved according to the present embodiment while the arm 8 is moved (refer to FIG. 1). The arrows in the view indicate the traveling direction of the excavating bucket 9. The dashed line G1 indicates the ground surface. The two dot chain line T1 indicates a trajectory T1 of the front ends of the teeth 23. Here, an operation of the excavating bucket 9, which is from a state where the front ends of the teeth 23 come into contact with the ground surface without the excavating bucket 9 digging into the ground (a state (A) in FIG. 6) to a state where the teeth 23 take a horizontal posture in the ground (a state (C) in FIG. 6) via a state where the teeth 23 dig into the ground (a state (B) in FIG. 6) is referred to as "penetration". In addition, an operation of the excavating bucket 9, which is from the state where the teeth 23 dig into the ground and take a horizontal posture (the state (C) in FIG. 6) up to a state where the front ends of the teeth 23 appear above the ground (a state (D) in FIG. 6), is referred to as "excavation".

The derricking width of the arm 8 during the excavation is set to a width to the extent that the position of the first hole 38 after movement does not exceed the position of the front ends of the teeth 23 prior to movement. As shown in FIG. 3 and FIG. 6, the bottom surface section 32 in the excavating bucket 9 according to the present embodiment is along the trajectory T1 of the front end of the teeth 23 in the state (D). As a result, in the excavating bucket 9 according to the present embodiment, it is possible to reduce contact pressure between the bottom surface section 32 of the excavating bucket 9 and the ground surface during excavation and it is possible to reduce excavation resistance.

Figure 7:
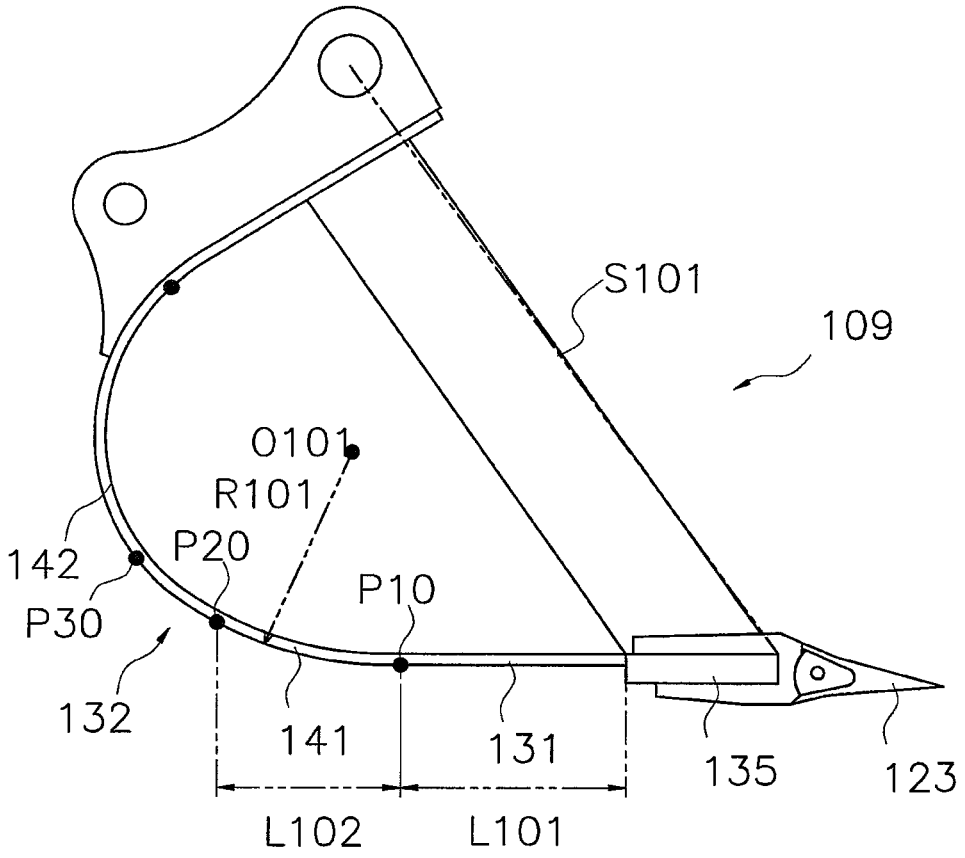
FIG. 7 is a side view illustrating an excavating bucket of comparative example 1.

FIG. 7 is a side view of the excavating bucket 109 according to comparative example 1. The excavating bucket 109 according to the comparative example has a wrist radius V (the length of a first virtual line S101) with the same length as the excavating bucket 9 according to the present embodiment. However, a curvature radius R101 of a first curved surface section 141 is smaller than the wrist radius V and a center O101 of the curvature radius R101 of the first curved surface section 141 in the side view is positioned inside the excavating bucket 109 and does not satisfy the (formula 5) described above.

In addition, a length L101 of a front surface section 131 of the excavating bucket 109 according to the comparative example is longer than the length L1 of the front surface section 31 of the excavating bucket 9 according to the present embodiment in the side view. In the excavating bucket 109 according to the comparative example, the length L101 of the front surface section 131 is longer than a length L102 of the first curved surface section 141 in the direction along a lip section 135.

Here, the front surface section 131 and the first curved surface section 141 are connected by a connecting section P10. The first curved surface section 141 and the second curved surface section 142 are connected at a connecting section P20. In addition, a portion P30 which is positioned to be the lowest with regard to a bottom surface section 132 in the horizontal state is included in the second curved surface section 142.

Figure 8:
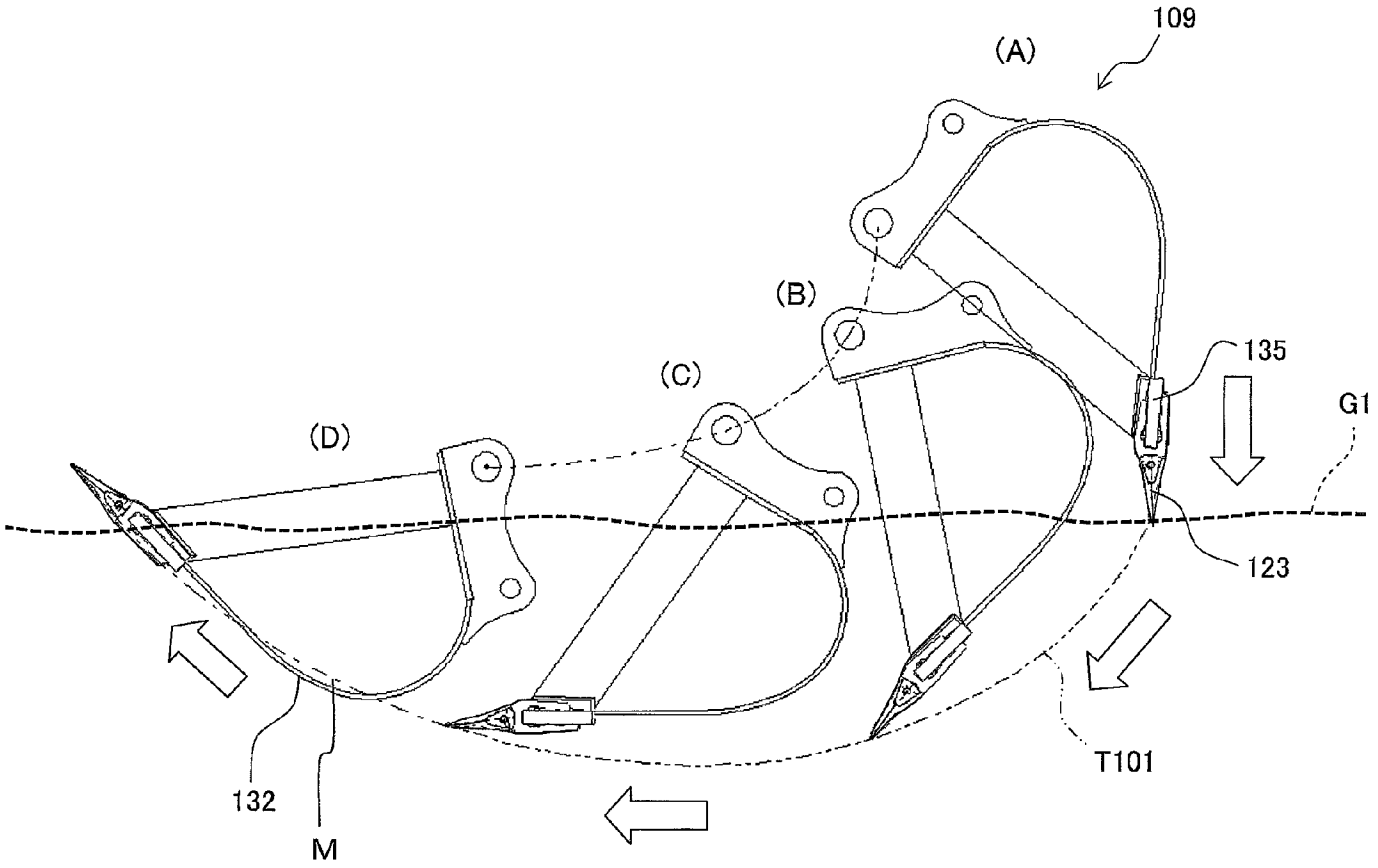
FIG. 8 is a view illustrating a trajectory of an excavating bucket of the comparative example of FIG. 7.

Next, for the excavating bucket 109 according to comparative example 1 described above, the trajectory of the excavating bucket 109, when the excavating bucket 109 is moved while the arm 8 is moved, is illustrated in FIG. 8. The derricking width of the arm 8 during the excavation (the operation from the state of (C) to the state of (D) in FIG. 8) is the same as in FIG. 6. In FIG. 8, the two dot chain line T101 shows a trajectory T101 of the front ends of the teeth 23. As shown in FIG. 8, in the excavating bucket 109 according to comparative example 1, a portion of the bottom surface section 132 protrudes below the trajectory T101 of the front ends of the teeth 123 in the state of (D). Accordingly, in the excavating bucket 109 according to comparative example 1, contact pressure between the bottom surface section 132 of the excavating bucket 109 and the ground surface increases during excavation and the excavation resistance increases. Here, the portion which protrudes is shown by M.

In this manner, in the excavating bucket 9 of the present embodiment, it is possible to reduce contact pressure between the bottom surface section 32 of the excavating bucket 9 and the ground surface during excavation and it is possible to reduce the excavation resistance compared to comparative example 1.

Wall Surface Drag Force and Pressing Amount of Excavating Bucket

Next, the wall surface drag and the pressing force of the excavating bucket of the present embodiment will be described below using an example.

Figure 9:
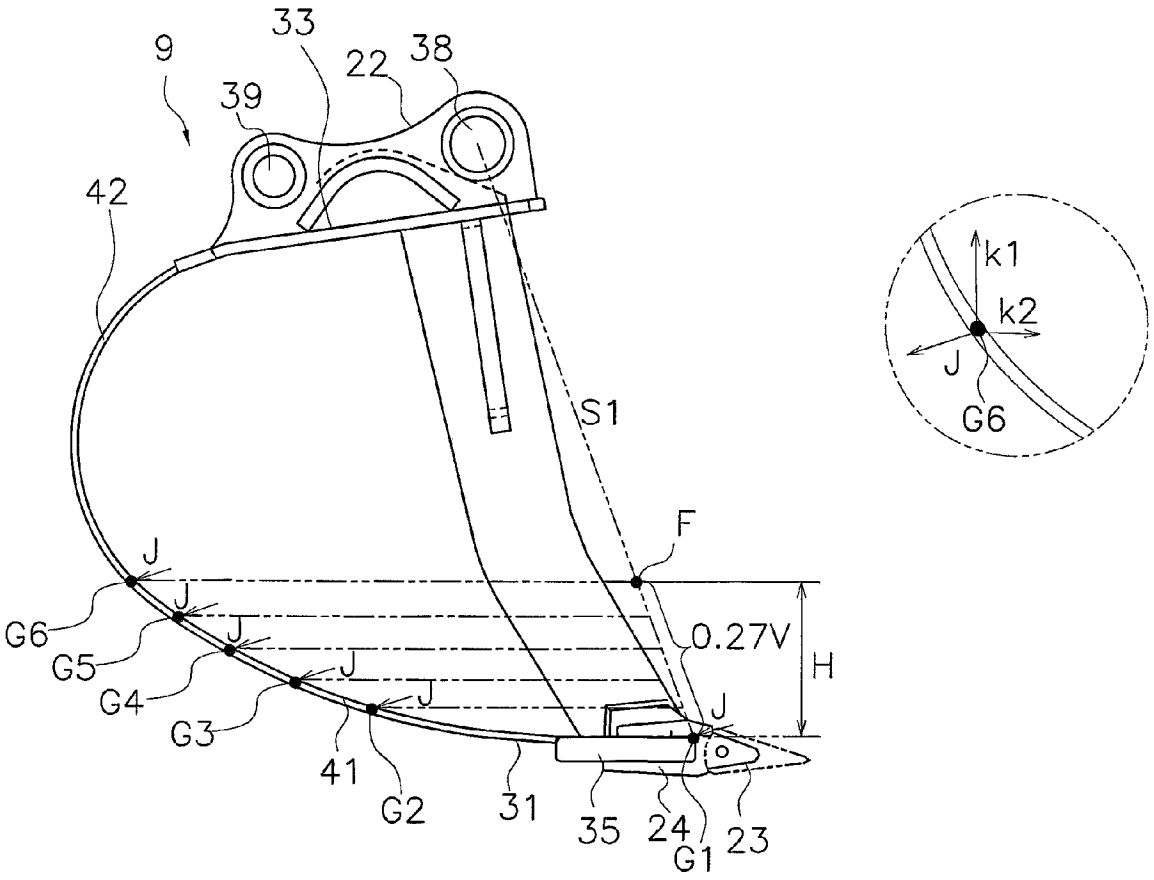
FIG. 9 is a side view of an excavating bucket of an embodiment where a lip section is arranged in a horizontal state.

FIG. 9 is a side view of the excavating bucket 9 of the present embodiment where the lip section 35 is arranged so as to be in a horizontal state. In the excavating bucket of example 1 which is an example of the present embodiment, the lip angle θ is set to 64°, the wrist radius V is set to 1771 mm, the bucket depth D is set to 1234 mm, the first curvature radius R1 is set to 1800 mm, and the second curvature radius R2 is set to 650 mm in the excavating bucket 9 shown in FIG. 9, and the bucket capacity V is 3.6 $m^3$.

Here, a portion from the front end of the lip section 35 along the virtual line S1 which is a length of 0.27 times (that is, 0.27 V) of the length of the virtual line S1 (the wrist radius V) is set as F. Then, a point where a horizontal line which passes through F and the bottom surface section 32 intersect is set as G6. In addition, the front end portion part of the lip section 35 is set as G1. G1 is in the same position as Q2 and is the front end of the horizontal surface section in the inside of the lip section 35. A width H between a horizontal line which passes through G1 and a horizontal line which passes through G6 is divided into 5 equal intervals, and the points where each of the horizontal lines which are divided into 5 equal intervals and the bottom surface section 32 intersect are set in order from the G1 side as G2, G3, G4, and G5. The region from G1 to G6 is set as the excavation region. As shown in the enlarged view (refer to the inside of the circle of the two-dot chain line) in FIG. 9, the vertical direction component of the reaction force which is generated on the wall surface when force is applied in the direction of the arrow J at each of the points G1 to G6 is set as the wall surface drag force k1, and the component k2 in the horizontal direction was set as the pressing force.

Figure 10:
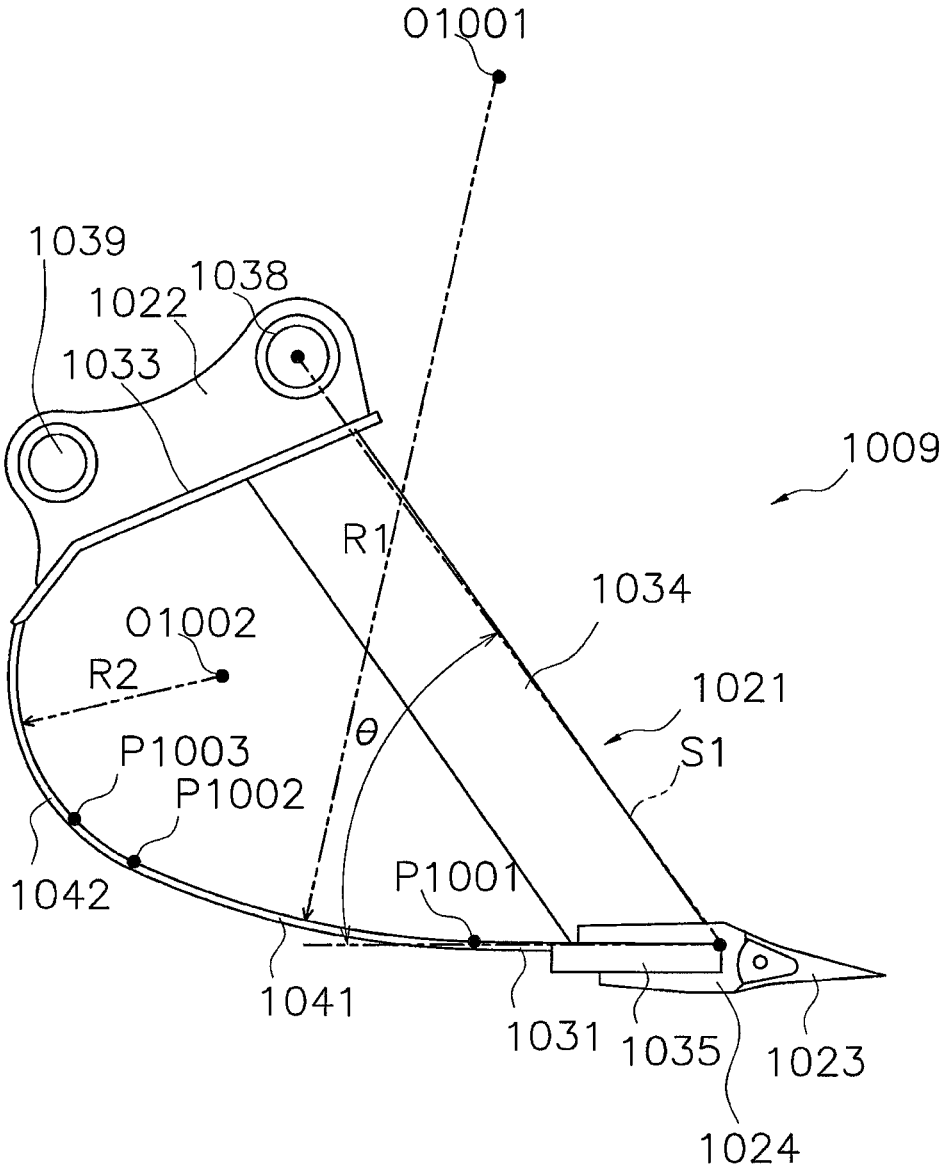
FIG. 10 is a side view illustrating an excavating bucket of comparative example 2.

Next, an investigation was also performed into the wall surface drag and the pressing force at the points G1 to G6 in the excavation region for an excavating bucket 1009 of comparative example 2. Here, FIG. 10 is a side view of the excavating bucket 1009 according to comparative example 2. The excavating bucket 1009 according to comparative example 2 satisfies (formula 5) described above, but the lip angle θ is formed to be smaller than 62° and (formula 1) described above is not satisfied.

The excavating bucket 1009 shown in FIG. 10 is provided with a bucket body 1021, a lip section 1035, tooth adapters 1024, a bracket 1022, and a plurality of teeth 1023. The bucket body 1021 has a front surface section 1031, a bottom surface section 1032, a rear surface section 1033, and a pair of side surface sections 1034. The bottom surface section 1032 has a first curved surface section 1041 and a second curved surface section 1042. The first curved surface section 1041 is linked with the front surface section 1031. Holes 1038 and 1039 for attaching an arm are provided in the bracket 1022. In addition, FIG. 10 illustrates a portion P1003 which is positioned to be the lowest in the horizontal state, a connecting section P1002 of the first curved surface section 1041 and the second curved surface section 1042, and a connecting section P1001 of the front surface section 1031 and the first curved surface section 1041. The bucket capacity of the excavating bucket 1009 of comparative example 2 is 2.1 $m^3$ and the depth of the bucket is set to 1021 mm. In addition, the lip angle θ of comparative example 2 is formed to be 52°.

Figure 11:
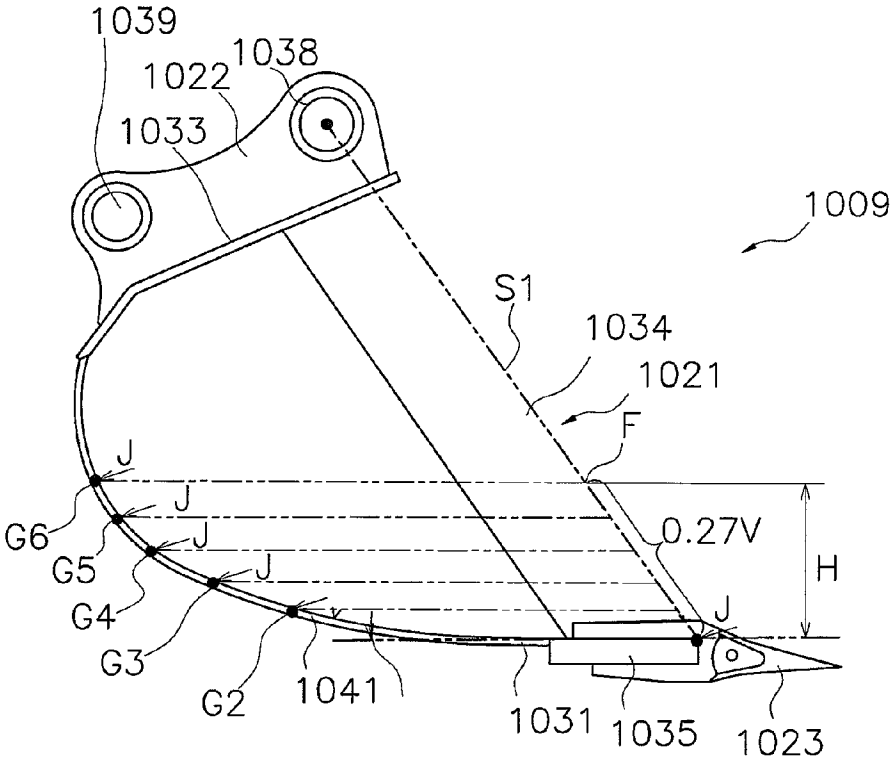
FIG. 11 is a side view diagram of the excavating bucket of comparative example 2 where the lip section is arranged to be in a horizontal state.

FIG. 11 is a side view where the excavating bucket 1009 of comparative example 2 is arranged such that the lip section 1035 is horizontal. As shown in FIG. 11, an excavation region is set and the points G1 to G6 are determined for the excavating bucket 1009 of comparative example 2 in the same manner as FIG. 9.

Figure 12:
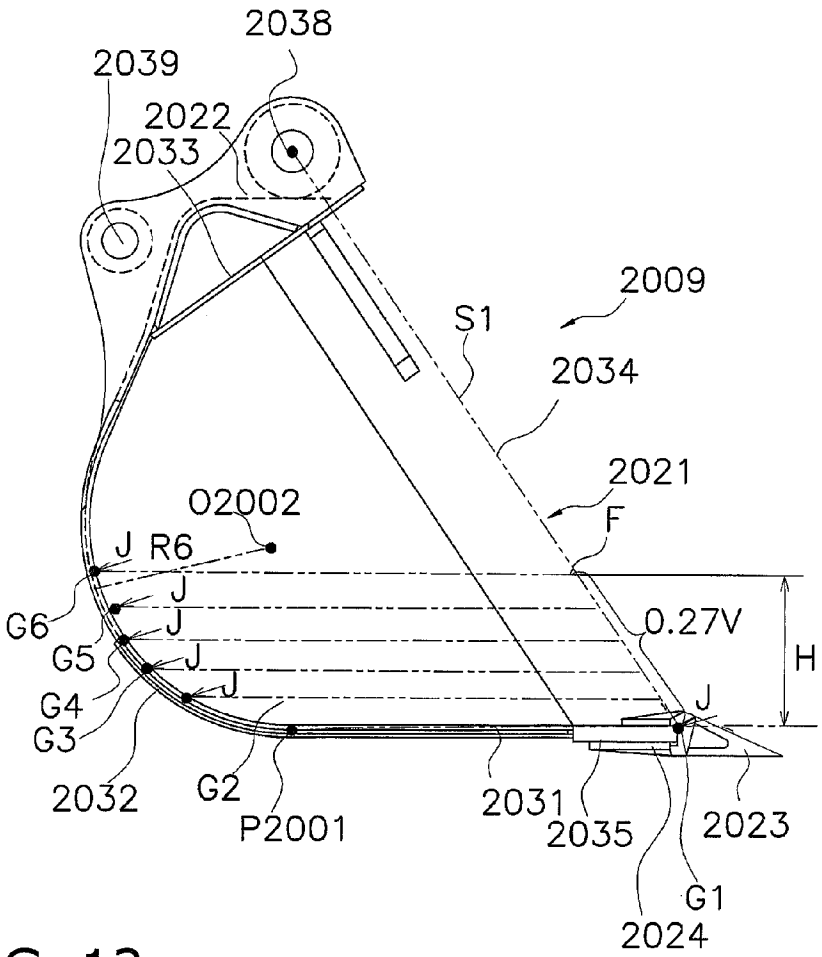
FIG. 12 is a side view of an excavating bucket of comparative example 3 where the lip section is arranged to be in a horizontal state.

Furthermore, an investigation was performed in the same manner for the excavating bucket of comparative example 3 shown in FIG. 12. An excavating bucket 2009 illustrated as comparative example 3 shown in FIG. 12 is different to the excavating bucket 9 of the present embodiment and a bottom surface section 2032 is configured by one curved surface section which has a predetermined curvature radius R6 in a side view. The excavating bucket 2009 is provided with a bucket body 2021, a lip section 2035, tooth adapters 2024, a bracket 2022, and a plurality of teeth 2023. The bucket body 2021 has a front surface section 2031, the bottom surface section 2032, a rear surface section 2033, and a pair of side surface sections 2034. The bottom surface section 2032 is configured by a curved surface section with the curvature radius R6 where O2002 is set as the center. Holes 2038 and 2039 for attaching an arm are provided in the bracket 2022. In addition, the connecting section P2001 of the front surface section 2031 and the bottom surface section 2032 is shown in FIG. 12.

In the excavating bucket 2009 of comparative example 3, the lip angle θ is set to 54° and the bucket depth D is set to 1435. An investigation was performed for the wall surface drag and the pressing force at points G1 to G6 in the excavation region with regard to the excavating bucket 2009 of comparative example 3.

Figure 13:
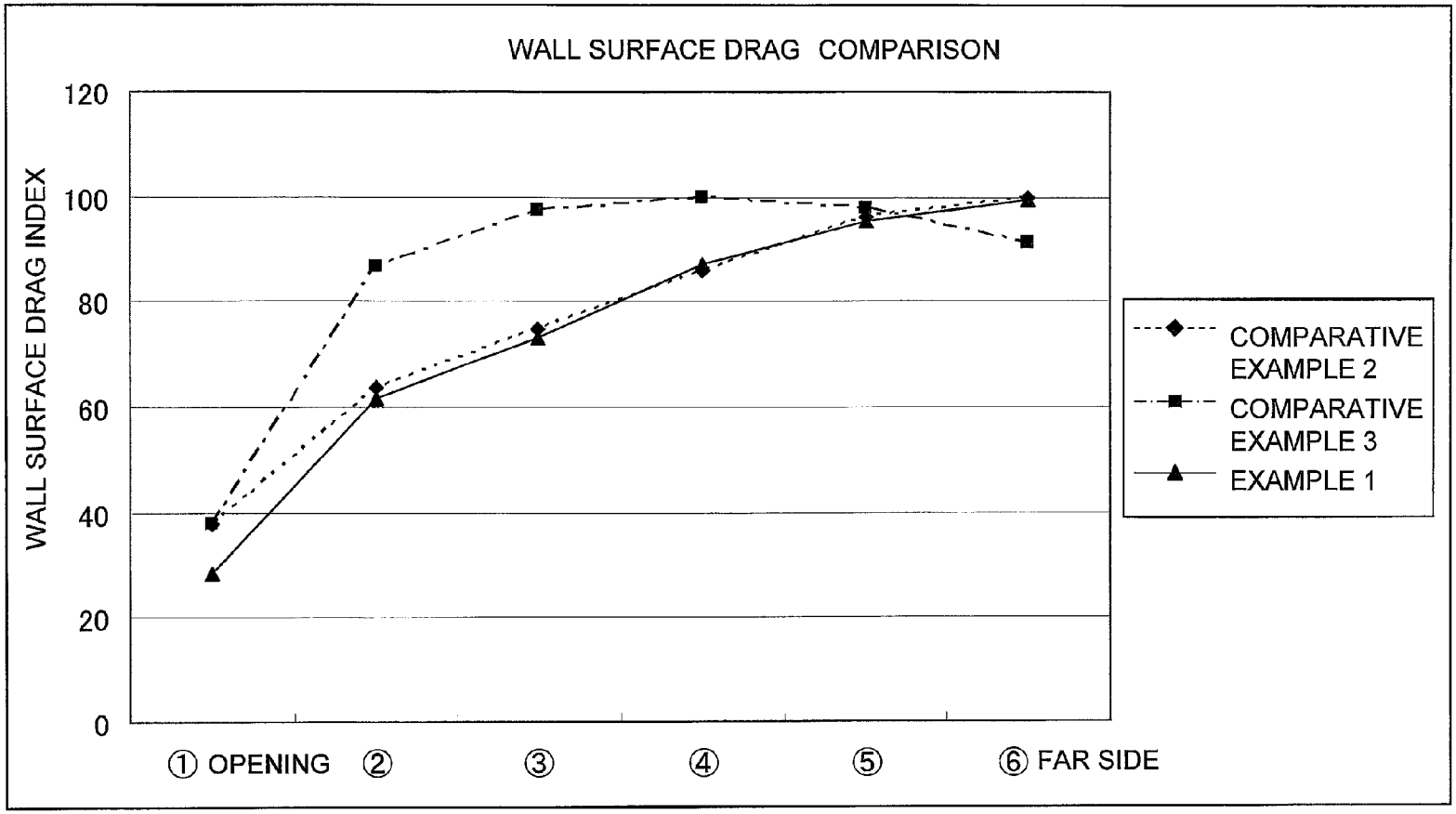
FIG. 13 is a diagram illustrating a graph of wall surface drag indexes for example 1, comparative example 2, and comparative example 3.

FIG. 13 is a diagram illustrating a graph of wall surface drag indexes for points G1 to G6 in example 1, comparative example 2, and comparative example 3. In FIG. 13, the solid line indicates the data for example 1, the dotted line indicates the data for comparative example 2, and the dash-dot line indicates the data for comparative example 3. Here, the wall surface drag index shown in FIG. 13 shows the degree of change when the force which is applied in the direction of the arrow J was set to 100.

Figure 14:
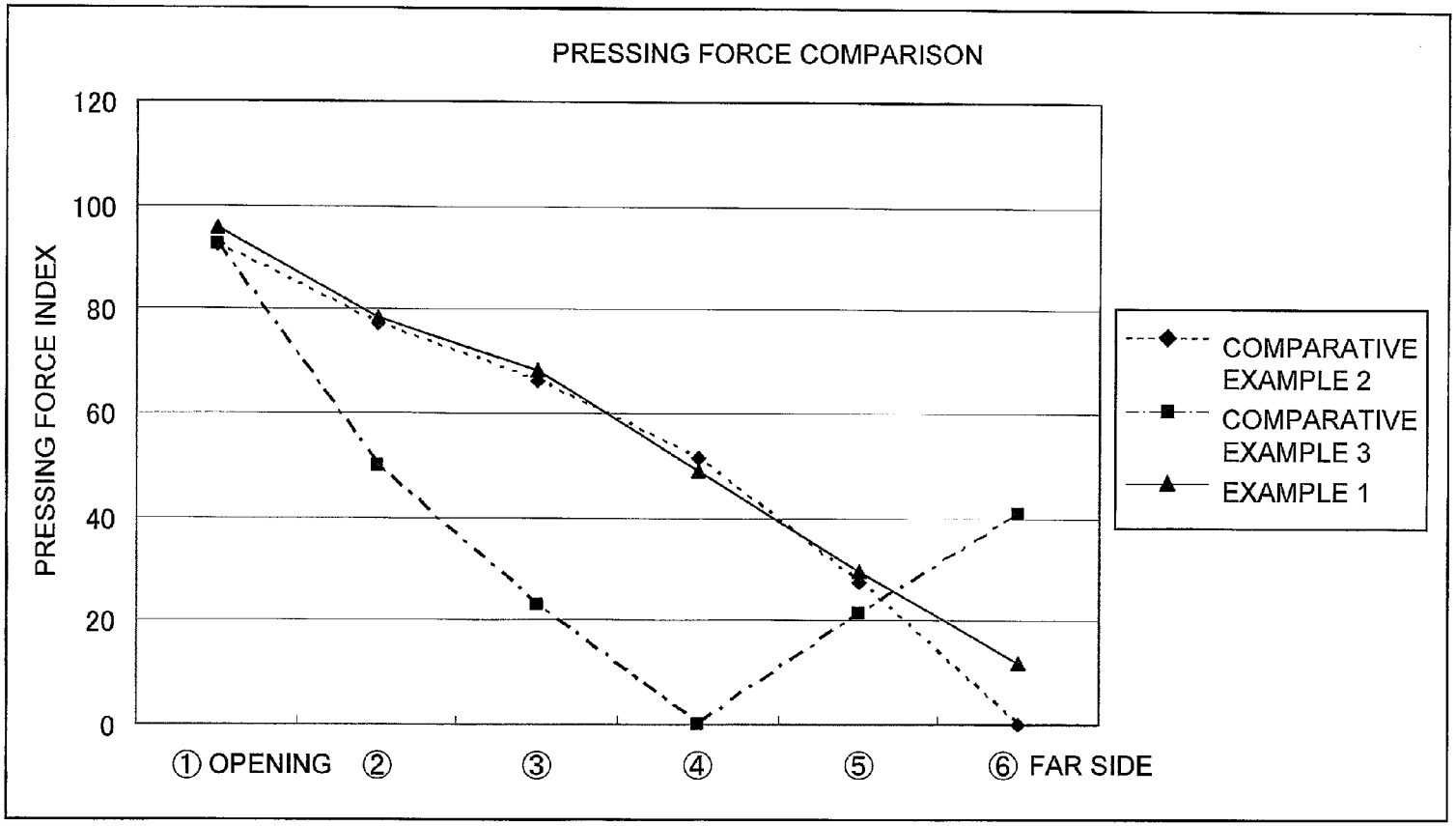
FIG. 14 is a diagram illustrating a graph of pressing force indexes for example 1, comparative example 2, and comparative example 3.

FIG. 14 is a diagram showing a graph of pressing force indexes for points G1 to G6 in example 1, comparative example 2, and comparative example 3. In FIG. 14, the solid line indicates the data for example 1, the dotted line indicates the data for comparative example 2, and the dash-dot line indicates the data for comparative example 3. Here, the pressing force index shown in FIG. 14 shows the degree of change when the force which is applied in the direction of the arrow J was set to 100.

As shown in FIG. 13 and FIG. 14, the wall surface drag force in comparative example 3 suddenly increases at G2 and the pressing force is zero at G4. As a result, the pressing force is reversed at G5 and G6 and becomes resistance.

On the other hand, in example 1 and comparative example 2 which satisfy (Formula 5), both the wall surface drag and the pressing force change smoothly, which is preferable.

In this manner, due to the bottom surface section 32 having the first curved surface section 41 and the second curved surface section 42, both the wall surface drag and the pressing force of the excavating bucket 9 of the present embodiment change smoothly, which is preferable, compared to comparative example 3 where the bottom surface section is configured by one curved surface section.

That is, it is possible for the excavating bucket 9 of the present embodiment to obtain a preferable wall surface drag and pressing force due to (Formula 5) being satisfied.

Lip Angle θ of Excavating Bucket

Figure 15:
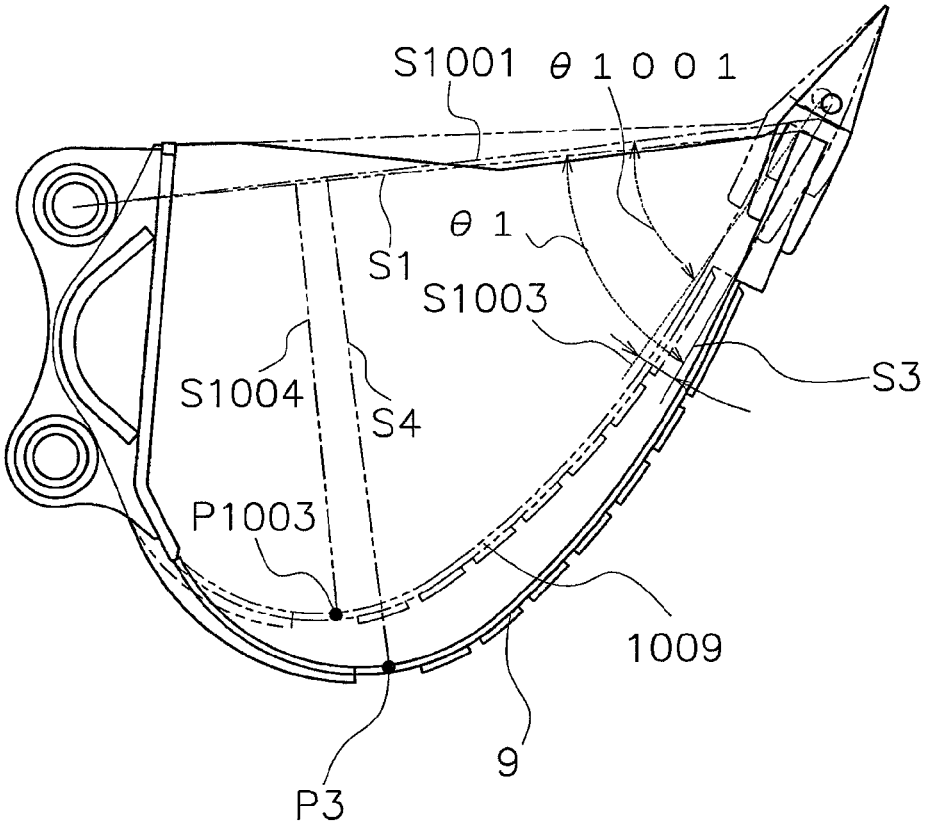
FIG. 15 is a side view illustrating the excavating bucket according to the present embodiment and the excavating bucket of comparative example 2.

FIG. 15 is a view illustrating an excavating bucket where the lip angle is 62 degrees or more as an example of the present embodiment superimposed with the excavating bucket of comparative example 2. The excavating bucket 9 which is an example of the present embodiment is shown by a solid line and the excavating bucket 1009 of comparative example 2 is shown by a two-dot chain line. In addition, a reference plane of the excavating bucket 1009 of comparative example 2 is shown by S1003 and the virtual line which shows the wrist radius is shown by S1001. In addition, the virtual line which shows the depth of the bucket of the comparative examples is shown by S1004.

As shown in FIG. 15, a lip angle θ1 of the excavating bucket 9 which is an example of the present embodiment is formed to be larger than a lip angle θ1001 of the excavating bucket 1009 of comparative example 2. As a result, the curvature of the bottom surface section 32 of the excavating bucket 9 which is an example of the present embodiment is larger compared to the excavating bucket 1009 of comparative example 2 and it is possible to deepen the bucket depth D as shown by the virtual lines S4 and S1004. Accordingly, in the excavating bucket 9 which is an example of the present embodiment, it is possible to increase the bucket capacity V even when the bucket width Z and the bucket bottom width Y are the same as the excavating bucket 1009 of comparative example 2.

Here, as shown in (Table 1) described later, in a case where the lip angle of the excavating bucket 9 is formed to be 62° as example 2 of the present embodiment, it is possible for the bucket capacity to be 2.3 $m^3$. On the other hand, in a case where the lip angle is formed to be 58.9° as in comparative example 4, the bucket capacity V is 2.1 $m^3$.

TABLE 1

| | EXAMPLE 2 | COMPARATIVE EXAMPLE 4 |
|---|---|---|
| LIP ANGLE θ (°) | 62 | 58.9 |
| BUCKET CAPACITY V ($m^3$) | 2.3 | 2.1 |

In this manner, it is possible to increase the bucket capacity compared to the excavating buckets in the conventional art by setting the lip angle θ to 62° or more.

Next, a case will be described where the lip angle θ is formed to be increased in sequence from 62°. Excavating buckets where the lip angle θ was set as 68°, 70°, and 72° were used as the excavating bucket of examples 3, 4, and 5 and excavating buckets where the lip angle θ was set as 64°, 76°, and 78° were used as the excavating buckets of comparative examples 5, 6, and 7. For each of the excavating buckets, protrusion amounts and the excavation resistance indexes in cases where the excavating buckets are moved while the arm 8 (refer to FIG. 1) is moved as shown in FIG. 6 and FIG. 8 are shown in the following (Table 2). Here, the excavated groove depth described later is the depth from the surface of the ground up to the deepest position when the ground surface is excavated. In addition, the protrusion amount is the amount which protrudes from the trajectory T101 as in the portion of M shown in FIG. 8.

TABLE 2

| | EXAMPLE 3 | EXAMPLE 4 | EXAMPLE 5 | COMPARATIVE EXAMPLE 5 | COMPARATIVE EXAMPLE 6 | COMPARATIVE EXAMPLE 7 |
|---|---|---|---|---|---|---|
| LIP ANGLE θ (°) | 68° | 70° | 72° | 74° | 76° | 78° |
| EXCAVATED GROOVE DEPTH | 582 | 582 | 582 | 582 | 582 | 582 |
| PROTRUSION AMOUNT(mm) | 0 | 0 | 0 | 41 | 90 | 142 |
| EXCAVATION RESISTANCE INDEX | 100 | 100 | 100 | 108 | 118 | 142 |

Figure 16:
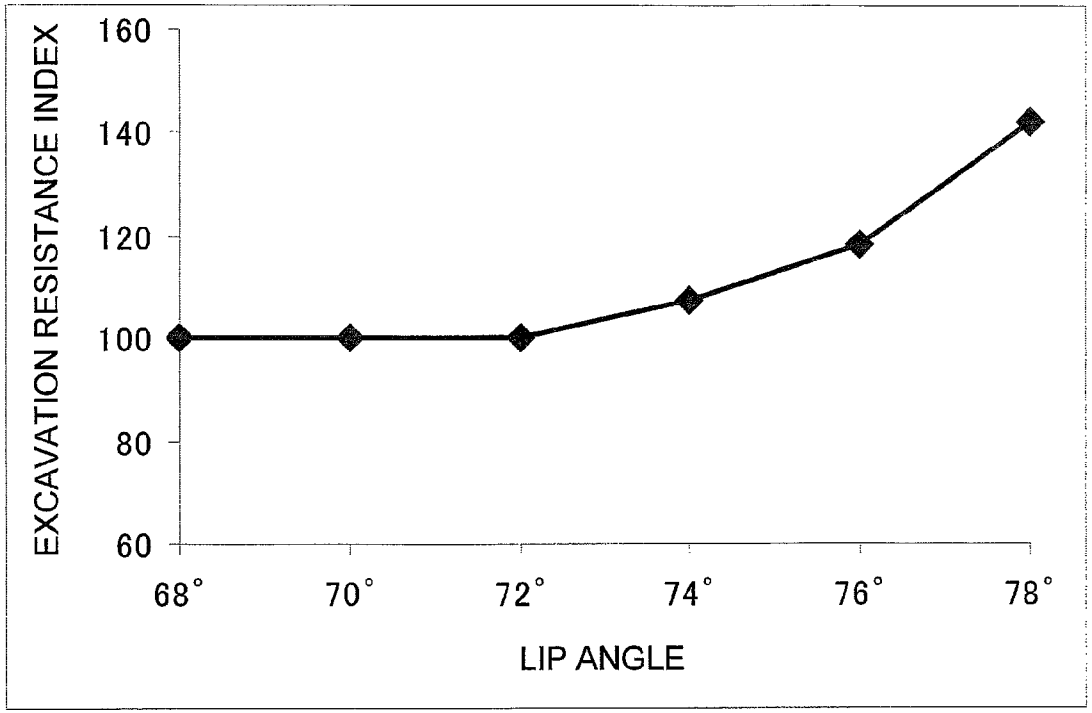
FIG. 16 is a diagram illustrates a graph of changes in excavation resistance indexes when the lip angle is changed.

In addition, the results of Table 2 are shown in FIG. 16 as a graph. The excavation resistance index shows the degree of change in the excavation resistance when the excavation resistance is set to 100 when there is no protrusion. As shown in FIG. 16, it is understood that, when the lip angle θ is larger than 72°, protrusions appear and the excavation resistance index increases.

From this, it is understood that it is possible to prevent an increase in the excavation resistance by setting the lip angle θ to 72° or less as in the excavating bucket 9 of the present embodiment.

As described above, by satisfying (Formula 5) and also satisfying (Formula 1) in the present embodiment, the wall surface drag and the pressing force are favorable and it is possible to increase the bucket capacity without a protrusion appearing or the excavation resistance increasing.

OTHER EXAMPLES

Next, for each of the dimensions of the excavating bucket 9 which is described in the embodiment described above, specific examples of the dimensions which satisfy all of (Formula 1) to (Formula 5) described above will be given.

Example 6

The lip angle θ was set to 63.4°, the wrist radius V was set to 1608 mm, the bucket depth D was set to 1151 mm, the bracket width W was set to 371 mm (0.371 m), the bucket width Z was set to 1560 mm, and the first curvature radius R1 was set to 1800 mm, and it is possible for the bucket capacity V to be 2.3 $m^3$. Here, at this time, the second curvature radius R2 is set to 400 mm and it is possible to set the bucket bottom width Y to 1271 mm.

Example 7

The lip angle θ was set to 70.7°, the wrist radius V was set to 2157 mm, the bucket depth D was set to 1424 mm, the bracket width W was set to 371 mm (0.371 m), the bucket width Z was set to 1715 mm, and the first curvature radius R1 was set to 1700 mm, and it is possible for the bucket capacity V to be 3.9 $m^3$. Here, at this time, the second curvature radius R2 is set to 500 mm and it is possible to set the bucket bottom width Y to 1373 mm.

(1) The excavating bucket 9 of the embodiments described above is attached to the arm 8 of the hydraulic excavator 100 as shown in FIG. 3 and is provided with the bucket body 21, the lip section 35, a bracket, and a cutting blade section. The bucket body 21 has the bottom surface section 32 which has two curved surface sections 41 and 42 with different radii of curvature in a side view, the rear surface section 33 which is linked with the bottom surface section 32, and a pair of side surface sections 34 which cover sides of a space which is surrounded by the bottom surface section 32 and the rear surface section 33. The lip section 35 is fixed to an edge portion of the bucket body 21 at an opposite side to the rear surface section 33. The bracket 22 has the hole 38, through which a coupling pin for attaching to the arm 8 passes, and is fixed to the rear surface section 33. The teeth 23 (an example of the cutting edge section) are fixed to the lip section 35. The length of the virtual line S1 which connects the center of the hole in the bracket 22 and a front end of the lip section 35 in a side view is set as the wrist radius. The line segment which is the longest among the line segments which are perpendicular with regard to the virtual line S1 and are from the virtual line S1 which to the bottom surface section 32 in a side view is set as a second virtual line S4 and the length of the second virtual line S4 is set as the depth of the bucket. The size of an angle which is formed by the lip section 35 and the virtual line S1 in a side view is set as the lip angle. The following is satisfied in a case where the wrist radius is set as V, the depth of the bucket is set as D, and the lip angle is set as θ: $62° \leq \theta \leq 72°$ and $0.7 \leq D/V \leq 0.8$.

By setting the lip angle θ to 62° or more, it is possible to achieve an increase in capacity even with the same width as the excavating buckets in the conventional art since it is possible to enlarge the curvature of the bottom surface section and to deepen the depth of the bucket. In this manner, since it is possible to increase the capacity without changing the width of the excavating bucket 9, it is possible to achieve an increase in capacity while suppressing the load on the arm 8.

In addition, the excavating bucket 9 rotates centered on the hole 38 of the bracket 22 during excavation, but in a case where the lip angle θ is larger than 72°, the bottom surface section 32 protrudes further downward than the trajectory of the front end of the teeth 23 and the excavation resistance increases. Furthermore, since the curvature of the bottom surface section is larger when the lip angle θ is larger than 72°, there are cases where it is difficult to secure the soil discharging performance of the soil which is excavated.

By setting the lip angle θ to 72° or less in the excavating bucket 9 of the present embodiment, it is possible for the bottom surface section 32 not to protrude downward further than the trajectory of the front end of the teeth 23 and it is possible to reduce excavation resistance as shown in FIG. 6. Furthermore, it is also possible for the excavating bucket 9 of the present embodiment to secure the soil discharging performance.

In addition, since an increase in the bucket capacity compared to the conventional art is achieved by adjusting the lip angle θ, it is possible to set the wrist radius of the excavating bucket of the present embodiment to the same length as the excavating buckets in the conventional art. Since control values of the body side of a hydraulic excavator are set according to the wrist radius, it is possible to easily switch the excavating bucket of the present embodiment without changing the control values.

Furthermore, the bucket depth D is further deepened by setting the bucket depth D divided by the wrist radius V to 0.7 or more, and it is possible to achieve an increase in the capacity compared to the conventional art. On the other hand, when the bucket depth D divided by the wrist radius V is increased to 0.8 or more, there are cases where the depth of the bucket is excessively deep with regard to the wrist radius V and it is difficult to secure the soil discharging performance or cases where the excavation resistance increases. As a result, it is possible to secure the soil discharging performance while reducing the excavation resistance by setting the bucket depth D divided by the wrist radius V to 0.8 or less.

(2) In the excavating bucket 9 according to the embodiment described above, the following is satisfied in a case where the width of the excavating bucket (the bucket width) is set as Z: $0.73 \leq D/Z/ \leq 0.83$.

When the value of the depth of the bucket divided by the bucket width is large, it is possible to increase the capacity of the bucket with regard to the bucket width. That is, by setting the value of the depth of the bucket divided by the bucket width to 0.73 or more, it is possible to increase the bucket capacity compared to the conventional art even when the width is the same as the excavating buckets in the conventional art. In addition, when the value of the depth of the bucket divided by the bucket width is larger than 0.83, there are cases where the depth of the bucket is excessively deep with regard to the bucket width and it is difficult to secure the soil discharging performance or cases where the excavation resistance increases. As a result, by setting the value of the depth of the bucket divided by the bucket width to 0.83 or less, it is possible to secure the soil discharging performance while reducing excavation resistance.

(3) The hydraulic excavator (an example of a work vehicle) of the embodiments described above is provided with the vehicle body 1, the boom 7 which is attached to the vehicle body 1, the arm 8 which is attached to the boom 7, and the excavating bucket 9 which is attached to the arm 8.

Due to this, since it is possible to increase the capacity without changing the width of the excavating bucket, it is possible to achieve an increase in capacity while suppressing the load on the arm 8.

Other Characteristics

Here, in the excavating bucket 9 of the embodiment described above, the bracket 22 shown in FIG. 5 has two opposing attachment sections 22*a* which are formed so as to protrude from the rear surface section 33 toward the outside. The front end of the arm 8 is attached between the two attachment sections 22*a*. In a case where the interval between the two attachment sections 22*a* is set as the bracket width, the bracket width is set as W (m), and the capacity of the excavating bucket is set as V ($m^3$), the following is satisfied: $6 \leq V/W \leq 11$.

The bracket width W is determined according to the size of the hydraulic excavator and it is possible to attach an excavating bucket with a larger capacity than in the conventional art to the hydraulic excavator due to the value of the bucket capacity divided by the bracket width being 6 or more. In addition, in a case where the value of the bucket capacity divided by the bracket width is larger than 11, there are cases where the depth of the bucket is excessively deep and it is difficult to secure the soil discharging performance or cases where the excavation resistance increases when the bucket width is kept at a fixed width. As a result, it is possible to secure the soil discharging performance while reducing the excavation resistance by setting the value of the bucket capacity divided by the bracket width to 11 or less.

An excavating bucket of any of the illustrated embodiments has an effect of being able to achieve an increase in capacity while suppressing the load on an arm, and is useful as a work vehicle such as a hydraulic excavator.

The invention claimed is:

1. An excavating bucket adapted to be attached to an arm of a work vehicle, the excavating bucket comprising:

a bucket body including a bottom surface section having two curved surface sections with different radii of curvature in a side view, a rear surface section linked with the bottom surface section, and a pair of side surface sections covering sides of a space surrounded by the bottom surface section and the rear surface section;

a lip section fixed to an edge portion of the bucket body at an opposite side to the rear surface section;

a bracket defining a hole, through which a coupling pin for attaching to the arm passes, and fixed to the rear surface section; and a cutting blade section fixed to the lip section, wherein when a length of a first virtual line connecting a center of the hole in the bracket and a front end of the lip section in the side view is set as a wrist radius V, a longest line segment among a plurality of line segments extending perpendicularly with regard to the first virtual line from the first virtual line to the bottom surface section in the side view is set as a second virtual line and a length of the second virtual line is set as a depth D of the excavating bucket, and an angle formed between the lip section and the first virtual line in the side view is set as a lip angle θ, $62° \leq \theta \leq 72°$ and $0.7 \leq D/V \leq 0.8$.

2. The excavating bucket according to claim 1, wherein when a width of the excavating bucket is set as Z $0.73 \leq D/Z \leq 0.83$.

3. A work vehicle comprising:

a vehicle body;

a boom attached to the vehicle body;

an arm attached to the boom; and the excavating bucket according to claim 1 attached to the arm.

4. A work vehicle comprising:

a vehicle body;

a boom attached to the vehicle body;

an arm attached to the boom; and the excavating bucket according to claim 2 attached to the arm.

* * * * *